US005495842A

United States Patent [19]

Yamanaka et al.

[11] Patent Number: 5,495,842

[45] Date of Patent: Mar. 5, 1996

[54] EVAPORATIVE FUEL-PROCESSING SYSTEM FOR INTERNAL COMBUSTION ENGINES

[75] Inventors: Masayoshi Yamanaka; Kazutomo Sawamura; Hiroshi Maruyama; Yasunari Seki, all of Wako, Japan

[73] Assignee: Honda Giken Kogyo Kabushiki Kaisha, Tokyo, Japan

[21] Appl. No.: 303,681

[22] Filed: Sep. 9, 1994

[30] Foreign Application Priority Data

Sep. 10, 1993 [JP] Japan ..... 5-249933
Nov. 25, 1993 [JP] Japan ..... 5-319155

[51] Int. Cl.[6] ..... F02M 25/08

[52] U.S. Cl. ..... 123/520

[58] Field of Search ..... 123/516, 518, 123/519, 520

[56] References Cited

U.S. PATENT DOCUMENTS

| | | | |
|---|---|---|---|
| 4,343,281 | 8/1982 | Vozumi et al. | 123/519 |
| 4,949,695 | 8/1990 | Uranishi et al. | 123/520 |
| 5,263,462 | 11/1993 | Reddy | 123/520 |
| 5,275,144 | 1/1994 | Gross | 123/520 |
| 5,333,589 | 8/1994 | Otsuka | 123/520 |
| 5,333,590 | 8/1994 | Thomson | 123/520 |
| 5,339,788 | 8/1994 | Blumenstock et al. | 123/520 |
| 5,363,828 | 11/1994 | Yamashita et al. | 123/520 |
| 5,383,438 | 1/1995 | Blumenstock | 123/520 |
| 5,398,662 | 3/1995 | Igarashi et al. | 123/520 |

FOREIGN PATENT DOCUMENTS 4-362264 12/1992 Japan .

*Primary Examiner*—Thomas N. Moulis
*Attorney, Agent, or Firm*—Nikaido, Marmelstein, Murray & Oram

[57] ABSTRACT

An evaporative fuel-processing system for an internal combustion engine includes an evaporative emission control system comprising charging passage extending between the canister and a fuel tank, a purging passage extending between the canister and an engine intake system, an open-to-atmosphere passage communicating the interior of the canister to the atmosphere, a purge control valve for opening and closing the purging passage, and an open-to-atmosphere valve for selectively opening and closing the open-to-atmosphere passage. A tank internal pressure sensor detects pressure within the evaporative emission control system. An ECU introduces negative pressure from the engine intake system into the evaporative emission control system and the fuel tank by opening the purge control valve and closing the open-to-atmosphere valve. The ECU compares a pressure value detected by the tank internal pressure sensor with a predetermined pressure value, and controls the valve opening amount of the purge control valve, based on the comparison results.

32 Claims, 9 Drawing Sheets

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, for purging evaporative fuel generated in the fuel tank into the intake system of the engine, and more particularly to an evaporative fuel-processing system of this kind which is capable of performing a diagnosis of abnormality of its own operation.

2. Prior Art

There has been known an evaporative fuel-processing system for an internal combustion engine having a fuel tank, which comprises a canister communicating with a fuel tank, and a purge control valve arranged across a purging passage extending from the canister to the intake system of the engine, wherein evaporative fuel generated in the fuel tank is temporarily stored in the canister and then suitably purged into the intake system of the engine. To determine abnormality of the thus constructed evaporative fuel-processing system, an abnormality-determining method has been proposed, e.g. by Japanese Provisional Patent Publication (Kokai) No. 4-362264, according to which the interior of the evaporative fuel-processing system is negatively pressurized, and then the purge control valve is closed, followed by determining a variation in the pressure within the evaporative fuel-processing system over a predetermined time period after the purge control valve is closed with the system negatively pressurized, to thereby determine whether or not there is an abnormality in the system, based on the determined variation.

However, according to the above proposed conventional method, a pressure sensor which detects pressure within the evaporative fuel-processing system is provided in a charging passage connecting between the fuel tank and the canister, and as a result, there can occur a pressure loss due to flow resistance of a portion of the charging passage extending between the pressure sensor and the fuel tank, so that a value of pressure detected by the pressure sensor (sensor output value) and the actual pressure within the fuel tank do not agree with each other, which may result in that the pressure within the fuel tank cannot be accurately reduced to a desired value.

SUMMARY OF THE INVENTION

It is the object of the invention to provide an evaporative fuel-processing system for internal combustion engines, which is capable of reducing pressure within a fuel tank to a desired value with accuracy, based on a value of pressure detected by a pressure sensor provided in a charging passage connecting between the fuel tank and a canister.

To attain the above object, the present invention provides an evaporative fuel-processing system for an internal combustion engine having an intake system, and a fuel tank, including evaporative emission control means having a canister for adsorbing evaporative fuel generated within the fuel tank, a charging passage extending between the canister and the fuel tank, a purging passage extending between the canister and the intake system of the engine, an open-to-atmosphere passage for communicating an interior of the canister with the atmosphere, a purge control valve arranged in the purging passage, for opening and closing the purging passage, the purge control valve having a valve opening amount thereof being controllable, and an open-to-atmosphere valve arranged in the open-to-atmosphere passage, for selectively opening and closing the open-to-atmosphere passage, and pressure detecting means arranged in the evaporative emission control means, for detecting pressure within the evaporative emission control means.

The evaporative fuel-processing system according to the invention is characterized by comprising:

negative pressure-introducing means for introducing negative pressure from the intake system of the engine into the evaporative emission control means and the fuel tank by opening the purge control valve and closing the open-to-atmosphere valve; and purge control means operable when the negative pressure-introducing means is operating, for comparing a value of the pressure within the evaporative emission control means detected by the pressure detecting means with a predetermined negative pressure value, and for controlling the valve opening amount of the purge control valve, based on results of the comparison.

Preferably, the purge control means compares the value of the pressure within the evaporative emission control means detected by the pressure detecting means with a first predetermined negative pressure value and a second predetermined negative pressure value which is lower than the first predetermined negative pressure value, the purge control means progressively increasing the valve opening amount of the purge control valve when the value of the pressure within the evaporative emission control means detected by the pressure detecting means reaches the first predetermined negative pressure value, and progressively decreasing the valve opening amount of the purge control valve when the value of the pressure within the evaporative emission control means detected by the pressure detecting means reaches the second predetermined negative pressure value.

More preferably, the purge control means changes the predetermined pressure value according to time elapsed after the negative pressure-introducing means starts to introduce the negative pressure from the intake system of the engine into the evaporative emission control means and the fuel tank.

Specifically, the purge control means changes the second predetermined negative pressure value such that it progressively becomes closer to the first predetermined negative pressure value as time elapses after the start of introduction of the negative pressure into the evaporative emission control means and the fuel tank.

Preferably, the first and second predetermined pressure values are an upper limit value and a lower limit value of a desired negative pressure value to which pressure within the evaporative emission control means is to be reduced by the introduction of the negative pressure into the evaporative emission control means and the fuel tank by the negative pressure-introducing means, respectively.

Also preferably, wherein the negative pressure-introducing means terminates the introduction of the negative pressure into the evaporative emission control means and the fuel tank when the valve opening amount of the purge control valve reaches a predetermined lower limit value after the start of the introduction of the negative pressure into the evaporative emission control means and the fuel tank.

Alternatively, the negative pressure-introducing means terminates the introduction of the negative pressure into the evaporative emission control means and the fuel tank when a predetermined period of time elapses after the valve opening amount of the purge control valve reaches a predetermined lower limit value after the start of the introduction of the negative pressure into the evaporative emission control means and the fuel tank.

Preferably, the negative pressure-introducing means terminates the introduction of the negative pressure into the evaporative emission control means and the fuel tank if the valve opening amount of the purge control valve does not yet reach a predetermined lower limit value when a predetermined period of time elapses after the start of the introduction of the negative pressure into the evaporative emission control means and the fuel tank.

Advantageously, the evaporative fuel-processing system according to the invention further includes open-loop purge control means operable when the negative pressure-introducing means is operating, for controlling the valve opening amount of the purge control valve, irrespective of the value of the pressure within the evaporative emission control means detected by the pressure detecting means.

Preferably, the open-loop purge control means executes the control of the valve opening amount of the purge control valve, before the the first-mentioned purge control means operates to control the valve opening amount.

More preferably, the open-loop purge control means terminates the control of the valve opening amount of the purge control valve when the pressure within the evaporative emission control means reaches a second predetermined negative pressure value.

Also preferably, the negative pressure-introducing means terminates the introduction of the negative pressure into the evaporative emission control means and the fuel tank if the pressure within the evaporative emission control means does not yet reach the second predetermined negative pressure value when a predetermined period of time elapses after the start of the introduction of the negative pressure into the evaporative emission control means and the fuel tank.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
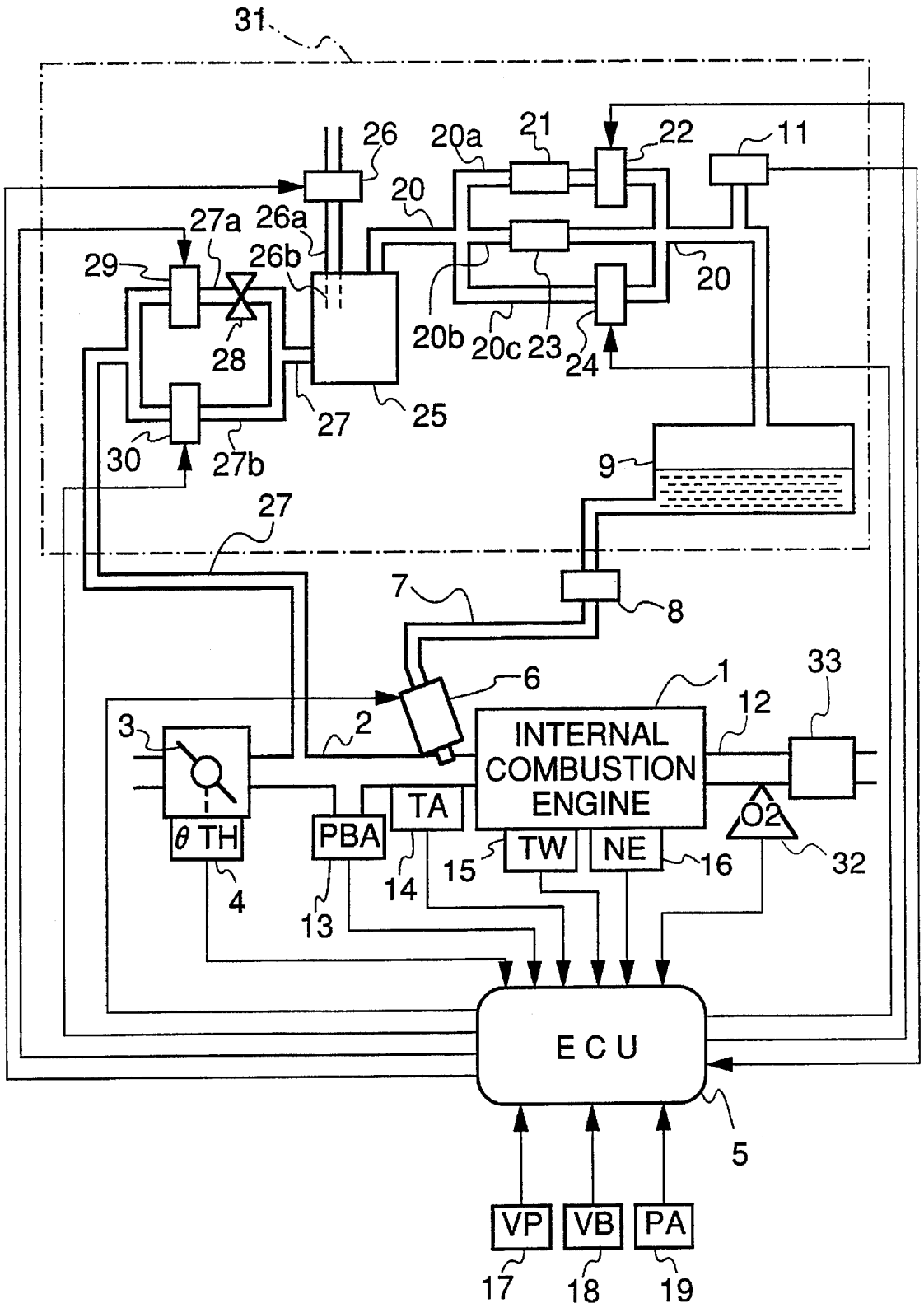
FIG. 1 is a block diagram schematically showing the whole arrangement of an internal combustion engine and an evaporative fuel-processing system therefor, according to an embodiment of the invention.

Referring first to FIG. 1, there is illustrated the whole arrangement of an internal combustion engine and an evaporative fuel-processing system therefor, according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2, across which is arranged a throttle valve 3. A throttle valve opening (θTH) sensor 4 is connected to the throttle valve 3, for generating an electric signal indicative of the sensed throttle valve opening and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective intake valves, not shown. The fuel injection valves 6 are connected to a fuel tank 9 via a fuel supply pipe 7 and a fuel pump 8 arranged thereacross. The fuel injection valves 6 are electrically connected to the ECU 5 to have their valve opening periods controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects intake air temperature TA, for supplying electric signals indicative of the sensed values to the ECU 5.

An engine coolant temperature (TW) sensor 15 formed of a thermistor or the like is inserted into a coolant passage formed in the cylinder block, which is filled with a coolant, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The NE sensor 16 generates a signal pulse as a TDC signal pulse at each of predetermined crank angles whenever the crankshaft rotates through 180 degrees, the pulse being supplied to the ECU 5.

Arranged across an exhaust pipe 12 is an O2 sensor 32 as an exhaust gas component concentration sensor for detecting the concentration VO2 of oxygen present in exhaust gases, and generating a signal indicative of the sensed oxygen concentration VO2 to the ECU 5. Further, a three-way catalyst 33 is arranged in the exhaust pipe 12 at a location downstream of the O2 sensor 32, for purifying exhaust gases in the exhaust pipe 12.

Further connected to the ECU 5 are a vehicle speed sensor 17 for detecting the traveling speed VP of an automotive vehicle on which the engine 1 is installed, a battery voltage sensor 18 for detecting output voltage VB from a battery, not shown, of the engine, and an atmospheric pressure sensor 19 for detecting atmospheric pressure PA, of which respective output signals indicative of the sensed values are supplied to the ECU 5.

Next, an evaporative emission control system (hereinafter referred to as "the emission control system") 31 will be described, which is comprised of the fuel tank 9, a charging passage 20, a canister 25, a purging passage 27, etc.

The fuel tank 9 is connected to the canister 25 via the charging passage 20 which has first to third branches 20*a* to 20*c*. A tank internal pressure sensor 11 is inserted in the charging passage 20 on one side of the branches 20*a* to 20*c* close to the fuel tank 9. The first branch 20*a* is provided with a one-way valve 21 and a puff loss valve 22 arranged thereacross. The one-way valve 21 is disposed such that it opens only when the tank internal pressure PTANK is higher than the atmospheric pressure by approximately 12 to 13 mmHg. The puff loss valve 22 is an electromagnetic valve, which is opened during purging of evaporative fuel, described hereinafter, and is closed while the engine is in stoppage. The operation of the valve 22 is controlled by a signal supplied from the ECU 5.

The second branch 20*b* is provided with a two-way valve 23 arranged thereacross, which is disposed such that it opens when the tank internal pressure PTANK is higher than the atmospheric pressure by approximately 20 mmHg and the tank internal pressure PT is lower than pressure on one side of the two-way valve 23 close to the canister 25 by a predetermined value.

The third branch 20*c* is provided with a bypass valve 24 arranged thereacross, which is a normally-closed electromagnetic valve, and is opened and closed during execution of abnormality determination, described hereinafter, by a signal from the ECU 5.

The canister 25 contains activated carbon for adsorbing evaporative fuel, and has an air inlet port 26*b*, via a passage (open-to-atmosphere passage) 26*a*. Arranged across the passage 26*a* is a drain shut valve 26, which is a normally-open type electromagnetic valve, and is temporarily closed during execution of the abnormality determination, by a signal from the ECU 5.

The canister 25 is connected via the purging passage 27 to the intake pipe 2 at a location downstream of the throttle valve 3. The purging passage 27 is bifurcated into first and second branches 27*a* and 27*b*. The first branch 27*a* is provided with a jet orifice 28 and a jet purge control valve 29 arranged thereacross, and the second branch 27*b* is provided with a purge control valve 30 arranged thereacross. The jet purge control valve 29 is an electromagnetic valve for controlling an amount of an air-fuel mixture to be purged, within a flow rate range which is so small as cannot be controlled by the purge control valve 30. The purge control valve 30 is an electromagnetic valve which is constructed such that the flow rate of the mixture can be continuously controlled by changing the on/off duty ratio of a control signal therefor. These electromagnetic valves 29 and 30 are controlled by signals from the ECU 5.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, puff loss valve 22, bypass valve 24, jet purge control valve 29, and purge control valve 30.

The CPU 5*b* operates in response to the abovementioned various engine parameter signals from the various sensors to determine operating conditions in which the engine 1 is operating, such as a feedback control region where the air-fuel ratio is controlled in response to the oxygen concentration in the exhaust gases detected by the O2 sensor 32, and open-loop control regions, and calculates, based upon the determined engine operating conditions, a fuel injection period Tout over which the fuel injection valve 6 is to be opened, in synchronism with generation of TDC signal pulses, by the use of the following equation (1):

$$Tout = Ti \times K1 \times KO2 + K2 \quad (1)$$

where Ti represents a basic value of the fuel injection period Tout, which is read from a Ti map according to the engine rotational speed NE and the intake pipe absolute pressure PBA.

KO2 represents an air-fuel ratio correction coefficient which is determined based on the concentration of oxygen present in exhaust gases detected by the O2 sensor 32 when the engine 1 is operating in the air-fuel ratio feedback control region, while it is set to predetermined values corresponding to the respective operating regions of the engine when the engine 1 is in the open-loop control regions.

K1 and K2 represent other correction coefficients and correction variables, respectively, which are set according to engine operating parameters to such values as optimize engine operating characteristics, such as fuel consumption and engine accelerability.

An abnormality diagnosis of the evaporative fuel-processing system constructed as above, according to the present embodiment will be carried out by sequentially executing PTANK monitoring, KO2 variation monitoring, canister monitoring, and tank monitoring.

The PTANK monitoring comprises always monitoring pressure PTANK within the fuel tank 9 detected by the tank internal pressure sensor 11, and determine whether or not there is a leak from the fuel tank 9, based on the monitored tank internal pressure PTANK. During the PTANK monitoring, negative pressurization to reduce the pressure within the fuel tank is not carried out.

The KO2 variation monitoring comprises monitoring variations in the air-fuel ratio correction coefficient KO2 during execution of the purging, and determining whether or not evaporative fuel has been supplied in large quantities into the engine intake system through the purging passage 27, based on the monitored variations.

The canister monitoring comprises introducing negative pressure (vacuum developed in the intake pipe 2) into the emission control system 31 to reduce pressure therewithin, and determine whether or not there is a leak from the canister 25, based on a change in the pressure within the emission control system 31 after the reduction of pressure within the emission control system 31.

The tank monitoring will now be described in detail with reference to FIGS. 2 to 6.

Figure 2:
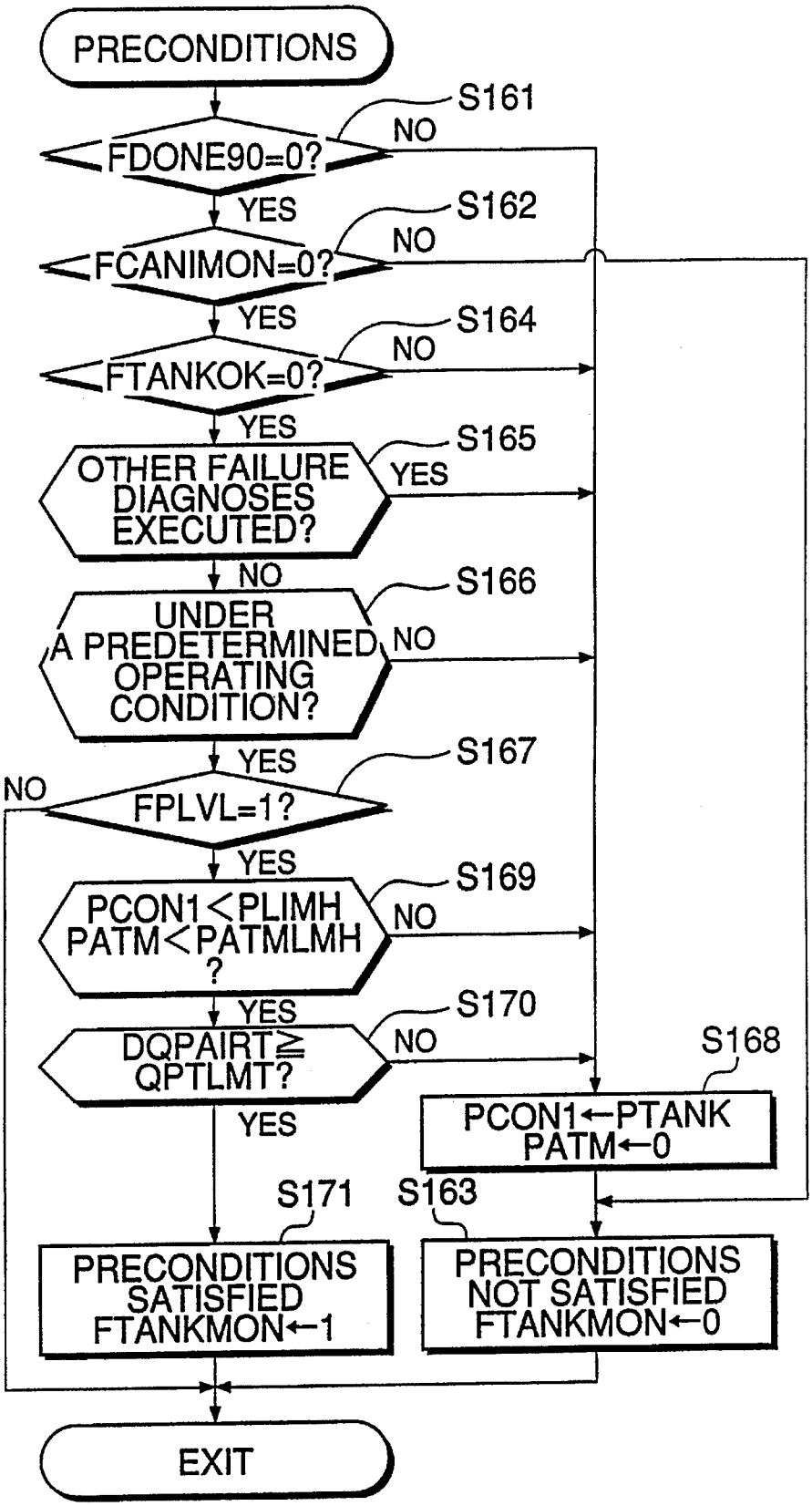
FIG. 2 is a flowchart showing a routine for determining preconditions for carrying out fuel tank monitoring.

FIG. 2 shows a program for determination of satisfaction of preconditions for carrying out the tank monitoring according to the present embodiment.

At a step S161, it is determined whether or not a flag FDONE90, which, when set to "1", indicates that the abnormality diagnosis of the fuel tank side or the canister side has been terminated, is set to "0". In the first loop of execution of the program, the answer to the question is affirmative (YES), and therefore the program proceeds to a step S162, wherein it is determined whether or not a flag FCANIMON, which, when set to "1", indicates that the preconditions for the canister monitoring are satisfied, is set to "0". If the flag FCANIMON is set to "1" and hence the answer to the question is negative (NO), it is determined that the canister is under monitoring in the present loop and hence the tank monitoring cannot be smoothly executed, and therefore the flag FTANKMON, which, when set to "1", indicates that the preconditions for the tank monitoring are satisfied, is set to "0" (unsatisfaction of the preconditions) at a step S163, followed by terminating the present routine.

If the flag FCANIMON is set to "0" and hence the answer to the question at the step S162 is affirmative (YES), it is determined at a step S164 whether or not a flag FTANKOK, which, when set to "1", indicates that the fuel tank side does not suffer from a leak and is in a normal state, is set to "0". In the first loop of execution of the program, the answer to the question is affirmative (YES), and therefore the program proceeds to a step S165, wherein it is determined whether or not any failure diagnosis other than the abnormality diagnosis according to the evaporative fuel-processing system of the present embodiment is being carried out. If the answer to the question is negative (NO), it is determined that execution of the present tank monitoring does not adversely affect the other failure diagnoses, followed by the program proceeding to a step S166. At the step S166, it is determined whether or not the engine 1 is operating in a predetermined operating condition, and if the answer to the question is affirmative (YES), the program proceeds to a step S167.

If any of the answers to the questions at the steps S161, S164 and S166 is negative (NO), or if the answer to the question at the step S165 is affirmative (YES), tank internal pressure (PCONI) before execution of the tank monitoring is set to a present value of the tank internal pressure PTANK and tank internal pressure PATM1 after open-to-atmosphere processing, which is carried out by another subroutine, is set to "0" at a step S168, and further the flag FTANKMON is set to "0" (unsatisfaction of the preconditions) at the step S163, followed by terminating the routine.

At the step S167, a flag FPLVL, which, when set to "1", indicates that negative pressurization of the fuel tank, described hereinafter, has been terminated, is set to "1". In the first loop of execution of the program, the answer to the question is negative (NO), and therefore the program proceeds to a step S169, wherein it is determined whether or not the initial pressure PCONI is lower than a predetermined upper limit value PLIMH and at the same time the tank internal pressure PATM after the open-to-atmosphere processing is lower than a predetermined upper limit value PATMLMH. If the answer to the question is affirmative (YES), it is determined that the amount of generation of evaporative fuel is not large, followed by the program proceeding to a step S170.

At the step S170, it is determined whether or not a cumulative purging flow rate value DQPAIRT is larger than a predetermined value QPTLMT. The cumulative purging flow rate value DQPAIRT is a value obtained by cumulating a purging flow rate calculated based on the valve opening of the purge control valve 30 and a difference (differential pressure) PBG between pressure upstream of the valve 30 and pressure downstream of same, after the start of the engine. If the answer to the question of the step S170 is affirmative (YES), it is determined that the amount of evaporative fuel stored in the canister 25 is not large and at the same time purging is accelerated, which means that execution of the canister monitoring will not unfavorably cause a large variation in the air-fuel ratio, and therefore the program proceeds to a step S171, wherein the flag FTANKMON is set to "1" (satisfaction of the preconditions), followed by terminating the present routine. On the other hand, if the answer to the question at the step S170 is negative (NO), the step S168 is executed, and then the program proceeds to the step S163, wherein the flag FTANKMON is set to "0" (unsatisfaction of the preconditions), followed by terminating the present routine.

In the above KO2 variation monitoring, if a variation in the KO2 value is larger than a predetermined threshold value KO2CHK, it is determined that a large amount of evaporative fuel is being purged, and therefore a flag FKO2OK is set to "1" and the cumulative flow rate value DQPAIRT is reset to "0". Thus, during execution of the KO2 variation monitoring, when the flag FKO2OK is set to "1", the cumulative flow rate value DQPAIRT is set to "0", so that the flow rate again starts to be cumulated from "0" as the cumulative value DQPAIRT. On the other hand, the preconditions for the tank monitoring are not satisfied if the cumulative flow rate value DQPAIRT does not reach the predetermined value QPTLM. Therefore, if the cumulative flow rate value DQPAIRT does not reach the predetermined value QPTLMT within a time period from the time the flag FKO2OK is set to "1" to the time the determination at the step S170 is actually carried out, the preconditions for the tank monitoring can be determined to be unsatisfied. In this manner, according to the present embodiment, when a large amount of evaporative fuel is purged so that the flag FKO2OK is set to "1", the preconditions are made unsatisfied and accordingly the tank monitoring is inhibited, whereby degraded drivability and exhaust emission characteristics due to an excessively rich state of the air-fuel ratio are prevented.

Figure 3A:
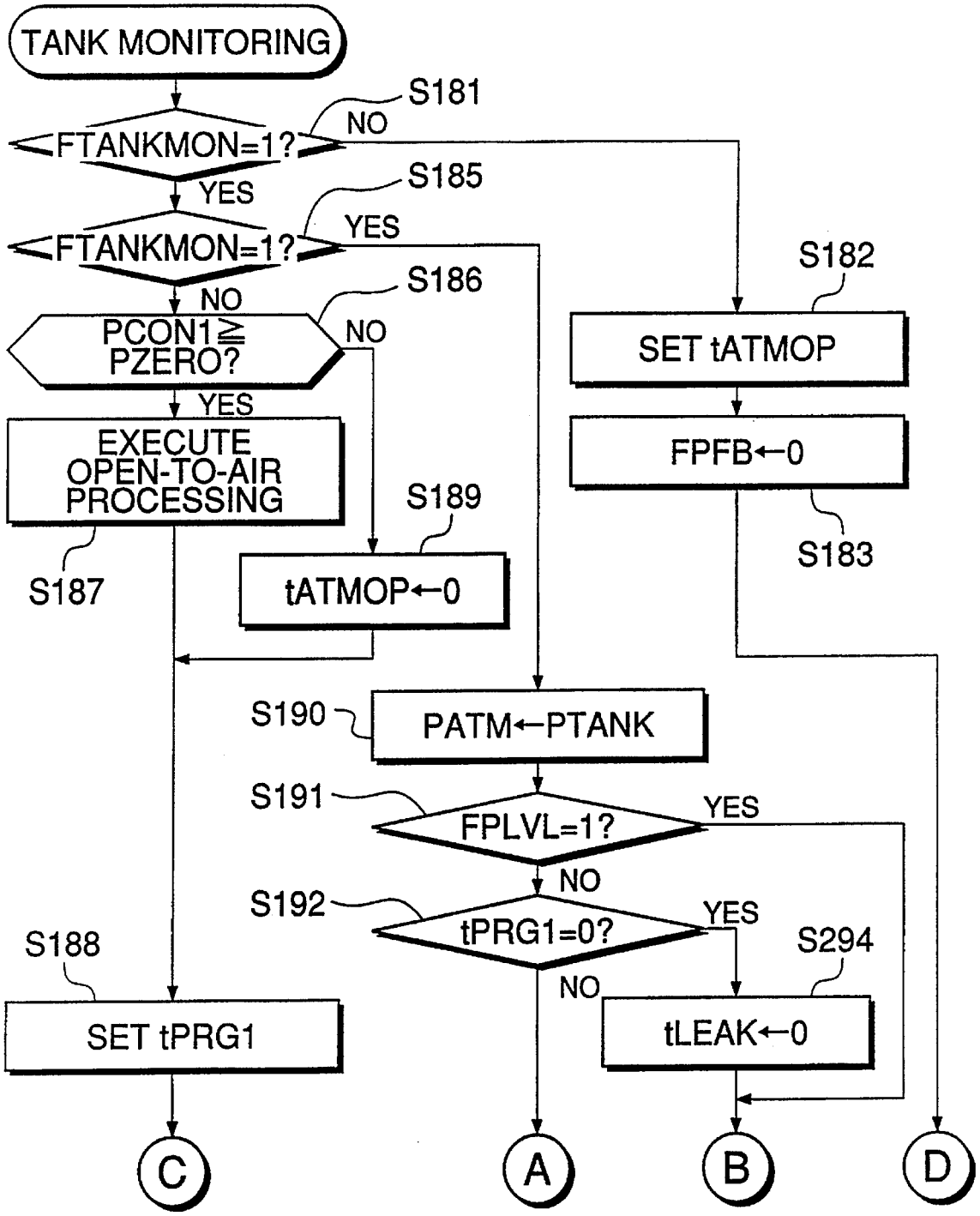
FIG. 3A is a flowchart showing a main routine for carrying out the fuel tank monitoring.
Figure 3B:
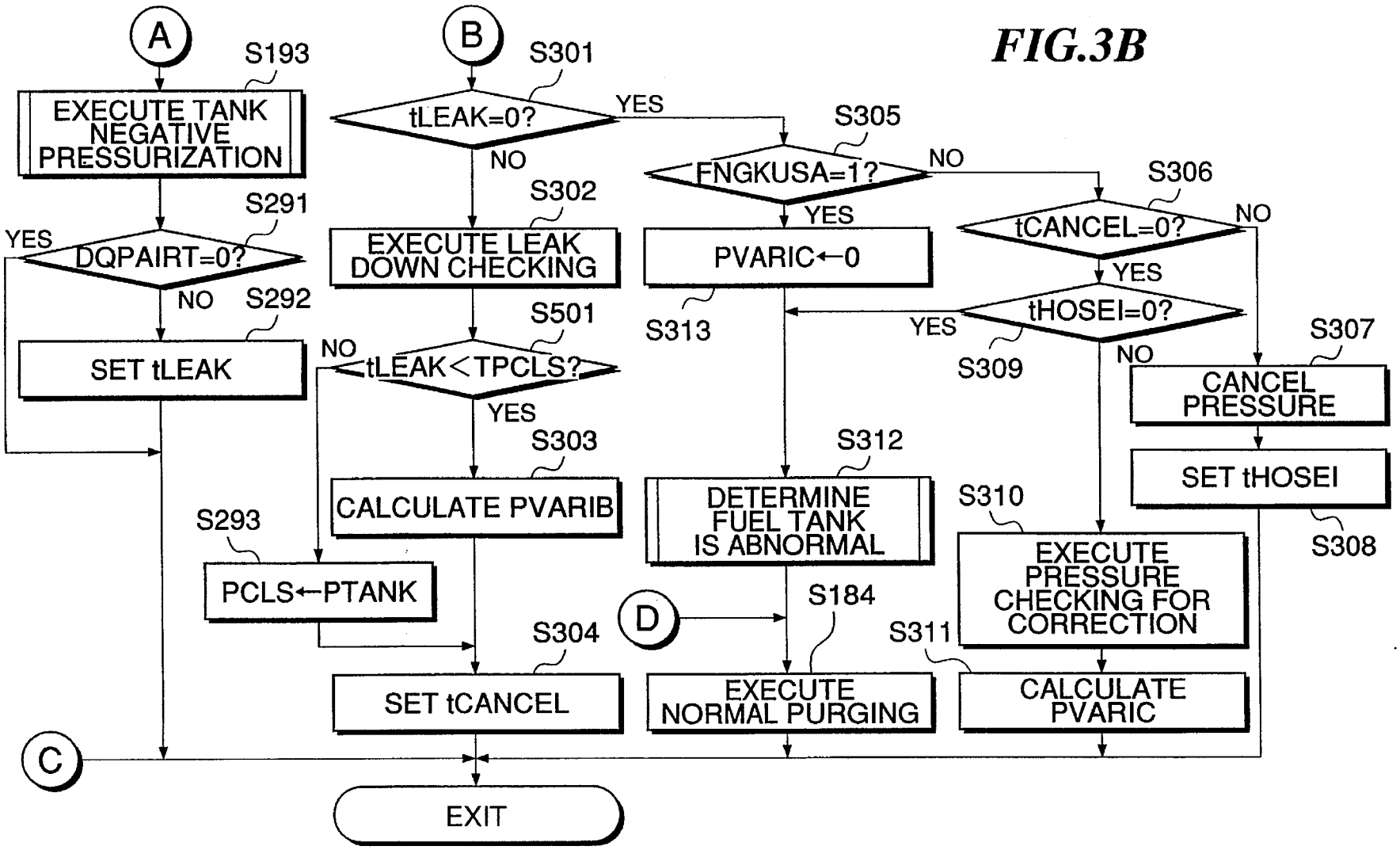
FIG. 3B is a continued part of the flowchart of FIG. 3A.

FIGS. 3A and 3B show a main routine for executing the tank monitoring according to the present embodiment.

At a step S181, it is determined whether or not the preconditions for the tank monitoring are satisfied according to the aforedescribed determination of preconditions satisfaction and hence the flag FTANKMON is set to "1". If the answer to the question is negative (NO), a tATMOP timer is set to a predetermined time period T11 required for the open-to-atmosphere processing, carried out hereinafter, to be completed, and then started, at a step S182. Then, at a step S183, a flag FPFB, which, when set to "1", indicates that feedback fuel tank negative pressurization, described hereinafter, is to be executed, is set to "0", and then the program returns to a normal purging mode executed at a step S184 in FIG. 3B, followed by terminating the present routine.

On the other hand, if the answer to the question at the step S181 is affirmative (YES), the program proceeds to a step S185, wherein it is determined whether or not the count value of the tATMOP timer has become equal to "0". In the first loop of execution of the program, the answer to the question is negative (NO), and therefore the program proceeds to a step S186, wherein it is determined whether or not the initial pressure value PCON1 is larger than a threshold value PZERO. If the answer to the question is affirmative (YES), the program proceeds to a step S187, wherein the bypass valve 24, puff loss valve 22, and drain shut valve 26 are opened, the purge control valve 30 is closed, and the jet purge control valve 28 is opened, to thereby relieve the emission control system 31 to the atmosphere. At the following step S188, a tPRG1 timer is set to a predetermined time period T12*a* required for open-loop fuel tank negative pressurization, carried out subsequently, to be completed, and started, followed by terminating the present routine.

If the answer to the question at the step S186 is negative (NO), it is determined that the fuel tank side has been already brought into a negatively pressurized state, and therefore the open-to-atmosphere processing is skipped over to a step S189, wherein the tATMOP timer is set to "0", and then the step S188 is executed, followed by terminating the present routine.

If the time period T11 has elapsed so that the count value of the tATMOP timer becomes equal to "0" and hence the answer to the question at the step S185 is affirmative (YES), the tank internal pressure PATM after the open-to-atmosphere processing is set to a present value of the tank internal pressure PTANK at a step S190, and then at the following step S191, it is determined whether or not the flag FPLVL is set to "1". In the first loop of execution of the step, the fuel tank negative pressurization has not been completed, so that the answer to the question is negative (NO), and therefore the step proceeds to steps S192 and S193 in order to carry out the fuel tank negative pressurization.

At the step S192, it is determined whether or not the count value of the tPRG1 timer has become equal to "0". In the first loop of execution of the step, the answer to the question is negative (NO), and therefore the program proceeds to the step S193, wherein the fuel tank negative pressurization is carried out according to a subroutine of FIGS. 4A and 4B. If the open-loop negative pressurization has not been completed within the predetermined time period T12*a*, it means that there is an abnormality in the evaporative emission control system or the fuel tank, such as formation of a large hole in the fuel tank. In such an event, it is impossible to carry out feedback negative pressurization of the evaporative emission control system, hereinafter described, and therefore the open-loop negative pressurization is interrupted, and then the program proceeds to steps S301 et seq.

According to the present embodiment, as stated previously, the tank internal pressure sensor 11 is mounted not within the fuel tank 9 but in the charging passage 20 at a location close to the branches 20*a* to 20*c*, which are located in the engine compartment. With this arrangement, there occurs a large difference between the output value from the tank internal pressure sensor 11 and the actual value of the tank internal pressure due to a pressure loss during execution of the negative pressurization. Therefore, the tank internal pressure cannot be accurately detected, which may result in that the fuel tank 9 cannot be negatively pressurized to a desired value with accuracy.

Figure 4A:
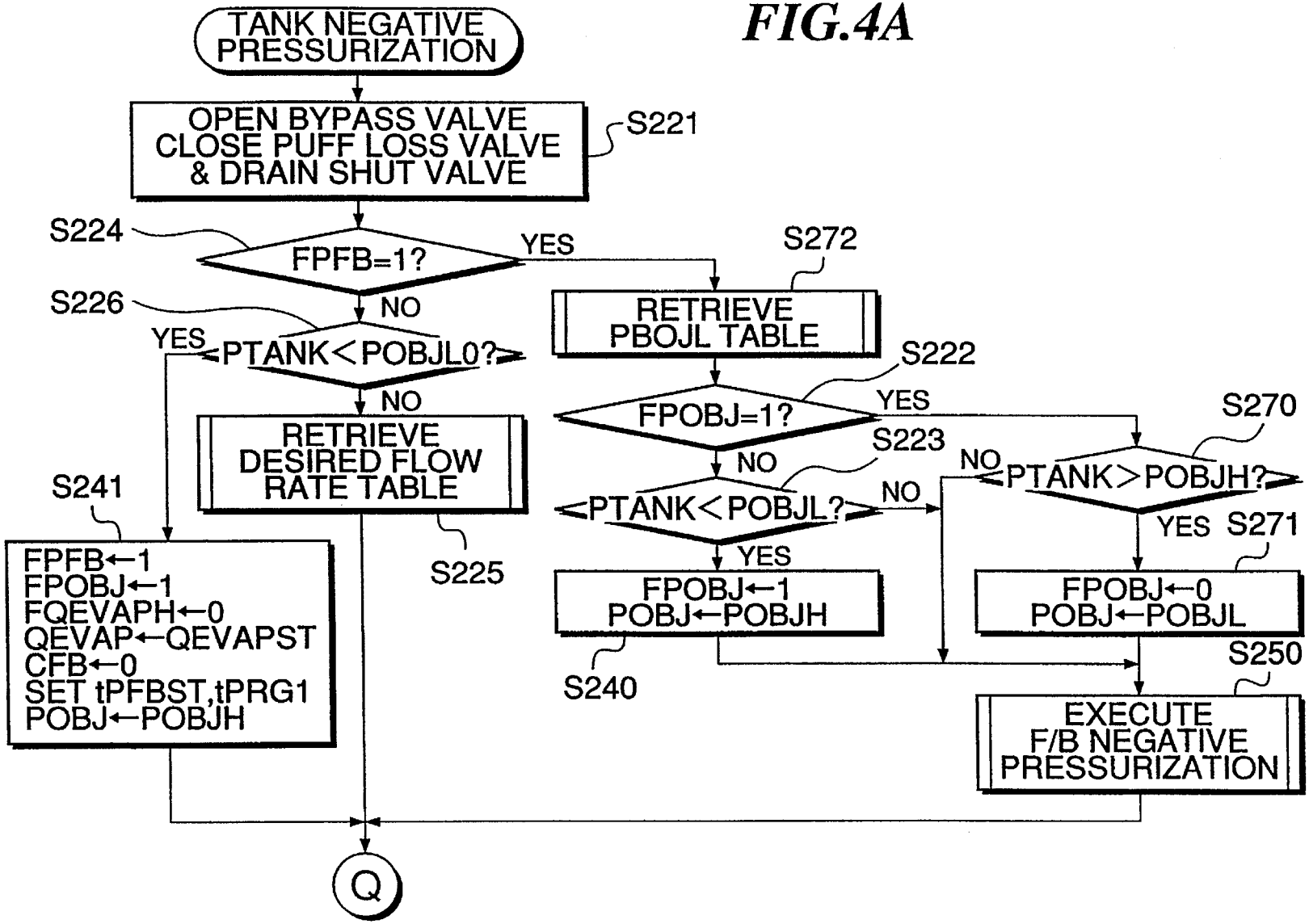
FIG. 4A is a flowchart showing a subroutine for carrying out fuel tank negative pressurization, which is executed during execution of the FIG. 3B routine.
Figure 4B:
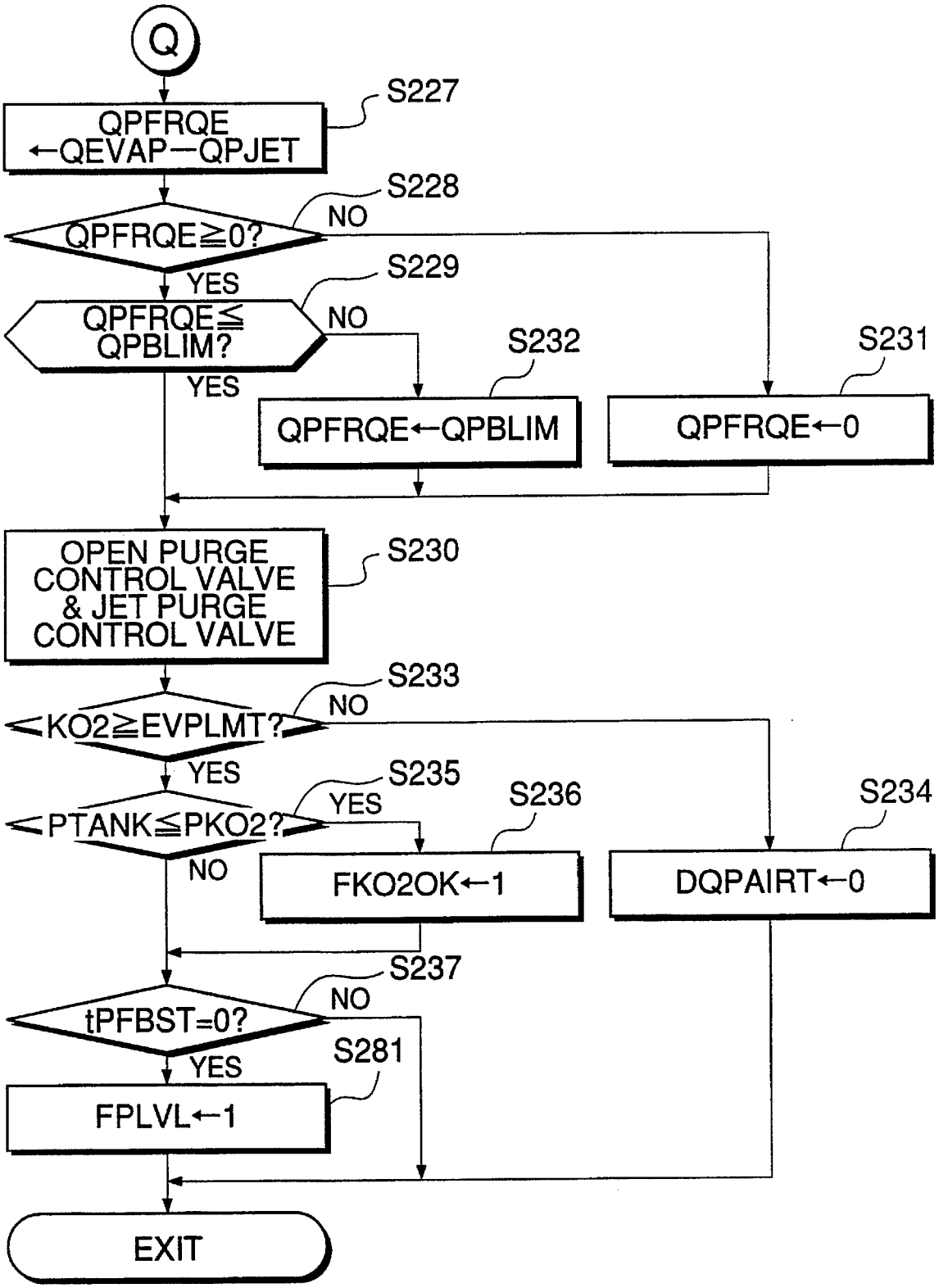
FIG. 4B is a continued part of the flowchart of FIG. 4A.

To eliminate the above inconvenience, according to the fuel tank negative pressurization of the present embodiment, the tank internal pressure is estimated from the output value from the tank internal pressure sensor 11 by the program in FIGS. 4A and 4B, to thereby enable negatively pressurizing the fuel tank 9 to the desired pressure value with accuracy.

At a step S221 in FIG. 4A, the bypass valve 24, is opened, and the puff loss valve 22 and the drain shut valve 26 are closed. Then, at a step S224, it is determined whether or not the flag FPFB, which is set to "1" when the PTANK value once falls below a predetermined lower limit value POBJL of a desired negative pressurization pressure value POBJ to which the tank internal pressure PTANK is to be reduced by negative pressurization, is set to "1". In the first loop of execution of the step, the answer to the question is negative (NO), and then the program proceeds to a step S226 to carry out the open-loop fuel tank negative pressurization. That is, at the step S226, it is determined whether or not the PTANK value is lower than an initial value POBJL0 of the predetermined lower limit value POBJL. In the first loop of execution of the step, the answer to the question is negative (NO), the program proceeds to a step S225. At the step S225, a desired flow rate table, which is stored in the memory means of the ECU 5, is retrieved to set a desired purging flow rate QEVAP, based on the present value of the tank internal pressure PTANK. The desired flow rate table is set such that a larger QEVAP value is selected as the PTANK value increases. During execution of the open-loop negative pressurization, the initial value POBJL0 of the lower limit value POBJL of the desired negative pressurization pressure value POBJ is set to a value corresponding to a count value of "0" of a CFB counter which is used in retrieving a POBJL table to be used in the feedback (F/B) fuel tank negative pressurization, hereinafter described.

Then, the program proceeds to a step S227 in FIG. 4B, wherein a purging flow rate QPFRQE to which the purging flow rate is to be controlled by the purge control valve 30 in the present loop is calculated by subtracting a flow rate QPJET through the jet purge control valve 29 from the desired purging flow rate QEVAP determined at the step S225. At the following step S228, it is determined whether or not the purging flow rate QPFRQE calculated at the step S227 is equal to or larger than "0". If the answer to the question is affirmative (YES), it is further determined whether or not the purging flow rate QPFRQE is equal to or smaller than a predetermined upper limit value QPBLIM, at a step S229. If the answer to the question is affirmative (YES), which means that $0 \leqq QPFRQE \leqq QPBLIM$ stands, and then the program proceeds to a step S230.

If the answers to the questions at the steps S228 and S229 are negative (NO), at a step S231 the QPFRQE value is set to the lower limit value "0", and then at a step S232 the QPFRQE value is set to the predetermined upper limit value QPBLIM, respectively, followed by the program proceeding to the step S230.

By virtue of the above described processings, the duty ratio of the purge control valve 30 can be calculated based on the negative pressure from the intake system. In addition, the duty ratio is controlled so that the purging flow rate QPFRQE is held at a value within the range defined by the upper and lower limit values. Thus, the variation of the air-fuel ratio during fuel tank negative pressurization can be reduced.

At the step S230, the purge control valve 30 is opened to an opening degree corresponding to the duty ratio, and the jet purge control valve 29 is kept open. Then, at a step S233 it is determined whether or not the air-fuel ratio correction coefficient KO2 is larger than a predetermined threshold value EVPLMT. If the answer to the question is negative (NO), it is determined that a considerably large amount of evaporative fuel is generated, which may cause a large variation in the KO2 value toward a limit value on the lean side, and then at a step S234, the cumulative flow rate value DQPAIRT is reset to "0" in order to inhibit the tank monitoring, followed by terminating the present routine.

On the other hand, if the answer to the question at the step S233 is affirmative (YES), it is determined that the amount of generation of evaporative fuel is small and therefore the tank monitoring can be executed with the air-fuel ratio held stable, and then the program proceeds to a step S235. At the step S235, it is determined whether or not the PTANK value is smaller than a predetermined threshold value PKO2. If the answer to the question is affirmative (YES), it is determined that evaporative fuel has been purged to cause negative pressurization of the fuel tank side, and therefore a flag FKO2OK, which, when set to "1", indicates that an air flow is present, is set to "1" at a step S236, followed by the program proceeding to a step S237. If the answer to the question of the step S235 is negative (NO), the program directly proceeds to the step S237.

At the step S237, it is determined whether or not a tPFBST timer, which is started at the start of the feedback (F/B) negative pressurization, is set to "0". In the first loop of execution of the step, the answer to the question is negative (NO) since the program is presently under the open-loop fuel tank negative pressurization, and therefore the present routine is immediately terminated.

Thereafter, when PTANK<POBJL0 stands during execution of the fuel tank negative pressurization and hence the answer to the question at the step S226 in FIG. 4A becomes affirmative (YES), the program proceeds to a step S241, wherein the flag FPFB is set to "1"; a flag FPOBJ is set to "1", which is set to and held at "1" after the PTANK value falls below the lower limit value POBJL of the desired negative pressurization pressure value POBJ and until it reaches predetermined upper limit value POBJH of same; a flag FQEVAPH is set to "0", which is set and reset in the F/B fuel tank negative pressurization, hereinafter described, and, when set to "1", indicates that the desired purging flow rate is held at an upper limit value thereof; the desired purging flow rate QEVAP is set to an initial value QEVAPST for the F/B fuel tank negative pressurization, described hereinafter; and the CFB counter, which counts the number of times of execution of the F/B fuel tank negative pressurization (step S250), is set to "0"; a tPFBST timer for determining timing of terminating the F/B fuel tank negative pressurization is set to a predetermined time period T13 and started; the aforementioned tPRG1 timer (steps S188 and S192 in FIG. 3A) is set to a predetermined timer period T12*b*, which is longer than the predetermined time period T12*a* and started; and the desired negative pressurization pressure value POBJ is set to the predetermined upper limit value POBJH.

After setting at the step S241, the program proceeds to the steps S227 to 237, followed by terminating the open-loop fuel tank negative pressurization. The time point the open-loop negative pressurization is terminated corresponds to a time point t1 in FIG. 6, at which the PTANK value has been negatively pressurized below the lower limit value POBJL0.

Figure 5:
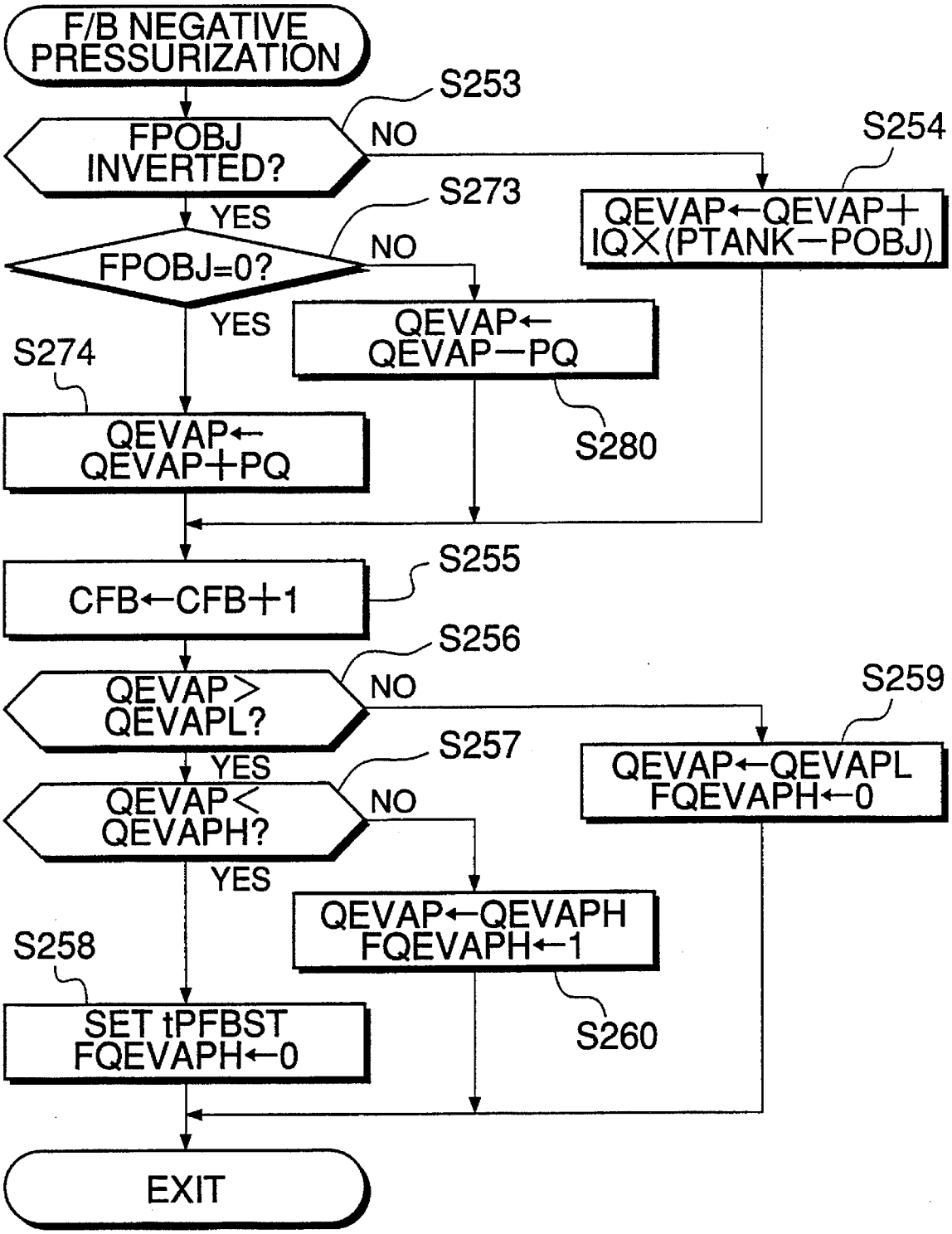
FIG. 5 is a flowchart showing a subroutine for carrying out F/B negative pressurization, which is executed during execution of the FIG. 4A routine.

In the next loop of execution of the program et seq., the flag FPFB is held at "1", and accordingly the answer to the question at the step S224 becomes affirmative (YES). Therefore, the program proceeds to a step S272, wherein the POBJL table stored in the memory means of the ECU 5 is retrieved to determine a value of the lower limit value POBJL of the desired negative pressurization pressure value POBJ, according to the count value of the CFB counter indicative of the number of times of execution of the F/B negative pressurization (FIG. 5). The POBJL table is set such that the POBJL value is set to a value closer to the upper limit value POBJH of the desired negative pressurization pressure value POBJ as the count value of the CFB counter increases.

Then, at a step S222, it is determined whether or not the flag FPOBJ is set to "1". In the first loop of execution of the step, since it has been set to "1" at the step S241, the answer is affirmative (YES), and the program proceeds to a step S270, wherein it is determined whether or not the present value of the PTANK value is larger than the desired negative pressurization pressure upper limit value POBJH. In the first loop of execution of the step, PTANK<POBJH stands, and therefore the program jumps to the step S250 to carry out the F/B fuel tank negative pressurization according to a program shown in FIG. 5.

At a first step S253 in FIG. 5, it is determined whether or not the flag FPOBJ has been inverted after the F/B fuel tank negative pressurization was started. In the first loop of execution of the program, the answer to the question is negative (NO), and therefore at a step S254 the desired purging flow rate QEVAP is calculated in order to decrease the value QEVAP, by the use of the following equation:

$$QEVAP=QEVAP+IQ\times(PTANK-POBJ) \quad (2)$$

where IQ represents a control gain for a purging flow rate I (integral) term and is set to a predetermined value. The POBJ value has been set to the upper limit value POBJH (step S241 in FIG. 4A) so that PTANK<POBJ, and therefore the QEVAP value is calculated to a decreased value.

Then, the program proceeds to a step S255, wherein the CFB counter for counting the number of times of execution of the present processing is incremented by a value of "1", and at the following step S256 it is determined whether or not the desired purging flow rate QEVAP is larger than a predetermined lower limit value QEVAPL thereof. If the answer to the question is affirmative (YES), it is determined at a step S257 whether or not the desired purging flow rate QEVAP is smaller than a predetermined upper limit value QEVAPH thereof. If the answer to the question is affirmative (YES), which means that QEVAPL<QEVAP<QEVAPH stands, the tPFBST timer for measuring a time period over which the QEVAP value is held at its limit value is set to the predetermined time period T13 and started, and the flag FQEVAPH, which, when set to "1" indicates that the QEVAP value is held at its upper limit value, is set to "0" at a step S258, followed by terminating the present routine.

On the other hand, if the answer to the question at the step S256 is negative (NO), the desired purging flow rate QEVAP is set to the lower limit value QEVAPL thereof and the flag FQEVAPH is set to "0" at a step S259, while if the answer to the question at the step S257 is negative (NO), the desired purging flow rate QEVAP is set to the upper limit value QEVAPH and the flag FQEVAPH is set to "1" at a step S260, followed by terminating the present F/B negative pressurization. Then, the program returns to the subroutine of FIG. 4B, wherein the steps S227 to S237 are executed, followed by terminating the FIG. 4 subroutine.

Thereafter, the PTANK value increases as the QEVAP value decreases. When PTANK>POBJH stands and accordingly the answer to the question of the step S270 becomes affirmative (YES) (time point t2 in FIG. 6), the program proceeds to a step S271, wherein the flag FPOBJ is reset to "0", and the lower limit value POBJL of the desired negative pressurization pressure value POBJ, determined based on the count value of the CFB counter is set as the desired negative pressurization pressure value POBJ. The lower limit value POBJ at this time point is set to a value closer to the upper limit value POBJH than in the last loop.

Then, the program proceeds to the F/B fuel tank negative pressurization in FIG. 5, wherein the answer to the question of the step S253 is affirmative (YES), and therefore the program proceeds to a step S273, wherein it is determined whether or not FPOBJ="0" stands. In the present loop, the answer to the question is affirmative (YES), and therefore at a step S274, wherein it is determined whether or not the Flag FPOBJ is set to "0". In the present loop, the answer is affirmative (YES), and accordingly at a step S274 the desired purging flow rate QEVAP is calculated in order to increase the value QEVAP, by the use of the following equation (3):

$$QEVAP=QEVAP+PQ \quad (3)$$

where PQ represents a purging flow rate P (proportional) term.

Thereafter, the steps S255 et seq. are repeatedly executed, followed by executing the FIG. 4A program and then terminating the program.

In the next loop of execution of the FIG. 4A program, the program proceeds to the step S222, wherein it is determined that FPOBJ="0" stands, and then the program proceeds to a step S223, wherein it is determined whether or not the PTANK value is lower than the lower limit value POBJL. In the first execution of this step, the answer is negative (NO), and then the program jumps to the step S250 to execute the same step, i.e. the F/B negative pressurization. Thereafter, in the F/B fuel tank negative pressurization, the steps S253 and S254 are repeatedly executed, so that the QEVAP value progressively increases and accordingly the PTANK value progressively decreases (t2–t3 in FIG. 6).

Figure 6:
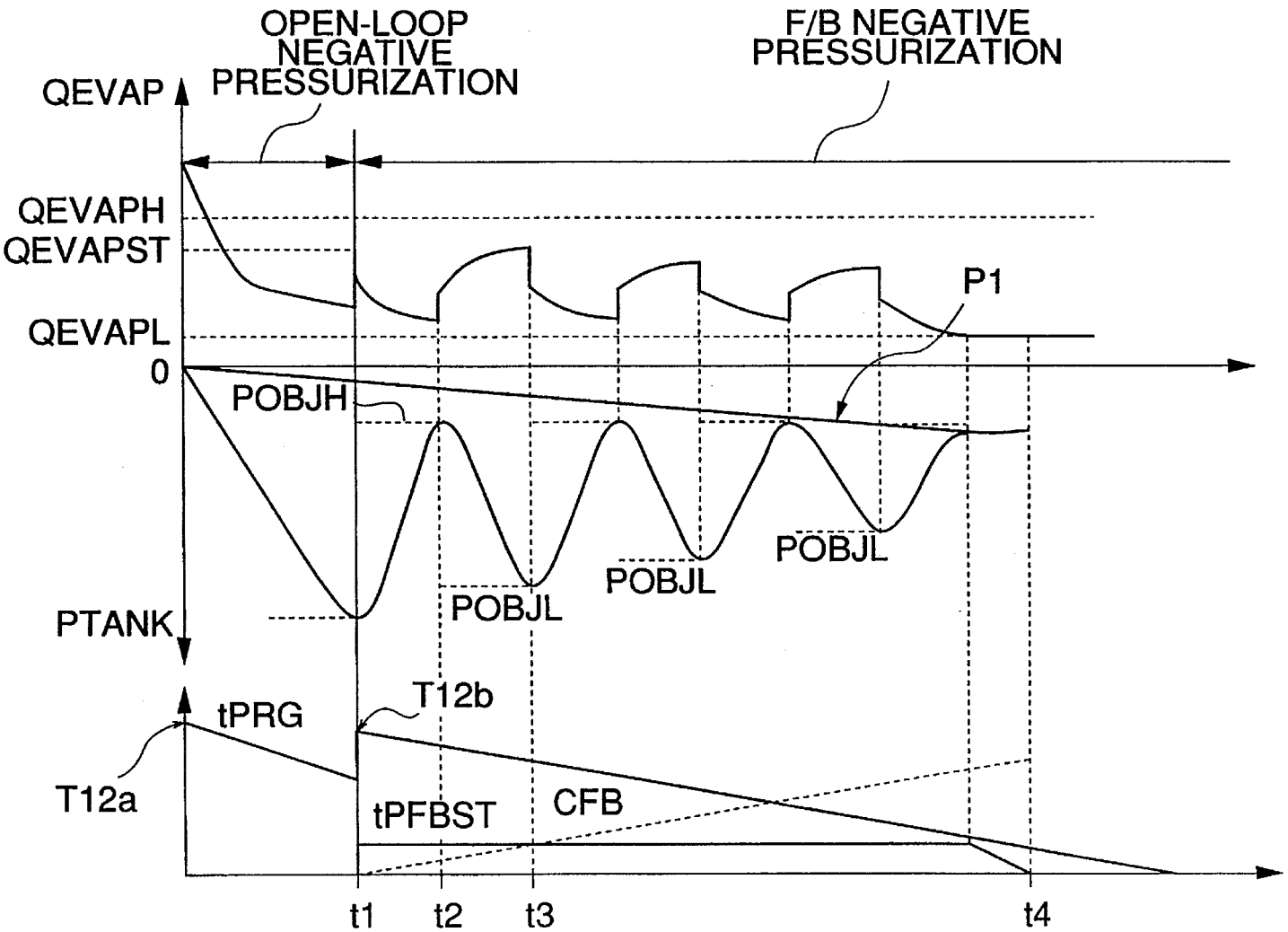
FIG. 6 is a timing chart showing changes in a desired purging flow rate QEVAP and tank internal pressure PTANK.

At the time point t3 in FIG. 6, PTANK<POBJL stands, and accordingly the answer to the question of the step S223 in FIG. 4A becomes affirmative (YES), so that the flag FOBJ is set to "1" and the desired negative pressurization pressure value POBJ is set to the upper limit value POBJH at the step S240, followed by executing the step S250. On this occasion, the program proceeds through the steps S253 and S273 in FIG. 5 to a step S280, wherein the desired purging flow rate QEVAP is calculated in order to decrease the value QEVAP, by the use of the following equation (4):

$$QEVAP=QEVAP-PQ \quad (4)$$

Thereafter, similar processing to that described above is repeatedly carried out, and if in a subsequent loop tPFBST=0 stands so that the answer to the question at the step S237 becomes affirmative (YES) (time point t4 in FIG. 6), it is determined that the flag FPOBJ has never been inverted over the predetermined time period T13 and therefore the time period T13 has elapsed after the QEVAP value became held at the upper limit value, and then the program proceeds to a step S281, wherein the flag FPLVL, which, when set to "1", indicates that the fuel tank negative pressurization has been terminated, is set to "1", followed by terminating the fuel tank negative pressurization.

As described above, according to the fuel tank negative pressurization of the present embodiment, after execution of the open-loop negative pressurization, the F/B negative pressurization is executed. During the latter processing, the purging flow rate is varied according to the output value PTANK from the tank internal pressure sensor 11. On this occasion, by progressively increasing the lower limit value POBJL of the desired negative pressurization pressure value POBJ toward the upper limit value POBJH, the amplitude of the PTANK value is reduced so that it can be finally converged to the desired negative pressurization pressure value. During the F/B negative pressurization thus carried out, the purging flow rate is progressively decreased as a whole, and it becomes equal to and held at the lower limit value QEVAPL when the PTANK value is converged to the desired negative pressurization pressure value. Since the purging flow rate is thus progressively decreased, the pressure loss during negative pressurization is largely diminished or eliminated, so that when the PTANK value is finally converged to the desired negative pressurization pressure value, the difference between the output value PTANK from the tank internal pressure sensor 11 and the actual fuel tank internal pressure is substantially equal to "0". As a result, the PTANK value assumed when it is converged to the desired negative pressurization pressure value is estimated to be equal to the actual tank internal pressure, which makes it possible to negatively pressurize the PTANK value to the desired negative pressurization pressure value with accuracy. P1 in FIG. 6 indicates an estimate value of the tank internal pressure.

Referring again to FIG. 3B, after the fuel tank negative pressurization is terminated, the program proceeds to a step S291, wherein it is determined whether or not the cumulative purging flow rate value DQPAIRT is equal to "0". When the cumulative purging flow rate value DQPAIRT is reset to "0" (at the step S234 in FIG. 4B) during execution of the fuel tank negative pressurization, the answer to the question is affirmative (YES), and then the present routine is terminated. In this case, the answer to the question at the step S170 in FIG. 2 will become negative (NO) in a subsequent loop, and therefore the preconditions for the tank monitoring will be determined to be unsatisfied.

If the answer to the question at the step S291 is negative (NO), a tLEAK timer is set to a predetermined time period (e.g. 16 seconds) T14 required for leak down checking, which is executed following the present fuel tank negative pressurization, to be completed, and started at a step S292, followed by terminating the program.

If the fuel tank negative pressurization has been carried out normally, FPLVL="1" stands, so that the answer to the question at the step S191 in FIG. 3A is affirmative (YES), and then the program proceeds to a step S301 in FIG. 3B. If tPRG1=0 becomes satisfied during the fuel tank negative pressurization and hence the answer to the question at the step S192 becomes affirmative (YES), which means that the open-loop fuel tank negative pressurization or the F/B fuel tank negative pressurization has not been terminated within the predetermined time period T12*a* or T12*b*, it is determined that there is a possibility that a leak has occurred from the fuel tank side, and therefore in order to skip a leak down checking in which a variation in the fuel tank pressure is checked, the tLEAK timer is set to "0" at a step S294, followed by the program proceeding to the step S301 in FIG. 3B.

At the step S301, it is determined whether or not tLEAK=0 stands. If the fuel tank negative pressurization has been carried out normally, the answer to the question at the step S301 is negative (NO) in the first loop of execution of the step, and then the program proceeds to a step S302, wherein the fuel tank side is set to a leak-down checking mode. That is, the bypass valve 24, jet purge control valve 29, and purge control valve 30 are closed, while the puff loss valve 22 and drain shut valve 26 are kept closed, and then the tank internal pressure PTANK is measured, and at a step S501 it is determined whether or not the count value of the tLEAK timer is smaller than a value corresponding to a predetermined time period TCLS (e.g. 15.5 seconds). In the first loop of execution of the step, tLEAK≧TCLS stands, and then a value of the PTANK value measured at this time is stored as an initial value PCLS at a step S293, followed by the program proceeding to a step S304.

When tLEAK<TCLS stands in a subsequent loop, the program proceeds to a step S303, wherein a value of the PTANK value then measured is stored as a value PLEAK, and based on the thus obtained PLEAK value, a variation PVARIB in the tank internal pressure PTANK per unit time during leak down checking is calculated, by the use of the following equation:

$$PVARIB=(PLEAK-PCLS)/T14$$

Further, a tCANCEL timer for measuring a time period required for completing pressure cancellation, referred to hereinafter, is set to a predetermined time period (e.g. 16 seconds) T15 at a step S304, followed by terminating the present routine.

On the other hand, if the answer to the question at the step S301 is affirmative (YES), the program proceeds to a step S305, wherein it is determined whether or not a flag FNGKUSA is set to "1". The flag FNGKUSA is set and reset in the PTANK monitoring processing, and indicates, when set to "1", that the tank internal pressure PTANK is held at a value equal to or close to the atmospheric pressure. If the answer to the question is negative (NO), it is determined whether or not the count value of the tCANCEL timer has become equal to "0" at a step S306. In the first loop of execution of the step, the answer to the question is negative (NO), and then the program proceeds to a step S307, wherein the pressure cancellation is executed. More specifically, the puff loss valve 22 and purge control valve 30 are held in respective closed states, while the bypass valve 24, drain shut valve 26, and jet purge control valve 29 are opened, to thereby make the pressure within the emission control system 31 substantially equal to the atmospheric pressure. A value of the tank internal pressure PTANK obtained after this pressure cancellation is stored as a value PATM1. Further, a tHOSEI timer, which measures a time period required for completing checking of positive pressure for correction, is set to a predetermined time period T16 and started at a step S308, followed by terminating the present routine.

If the answer to the question at the step S306 is affirmative (YES), it is determined at a step S309 whether or not the count value of the tHOSEI timer has become equal to "0". In the first loop of execution of the step, the answer to the question is negative (NO), and therefore the checking of positive pressure for correction is executed at a step S310. To carry out the checking of positive pressure for correction, the bypass valve 24 is closed, the puff loss valve 22 and purge control valve 30 are held in respective closed states, and the drain shut valve 26 and jet purge control valve 29 are held in respective open states, and a value of the tank internal pressure PTANK detected under the above valve set condition is stored as a value PEND. Further, a variation PVARIC in the tank internal pressure PTANK per unit time during positive pressure checking for correction is calculated based on the above obtained PEND value at a step S311, by the use of the following equation:

$$PVARIC=(PEND-PATM1)/T16$$

If the answer to the question at the step S309 becomes affirmative (YES), the program proceeds to a step S312, wherein abnormality determination, described hereinafter, is carried out.

If the answer to the question at the step S305 is affirmative (YES), i.e. if the flag FNGKUSA is set to "1", the program skips over the aforesaid pressure cancellation and the positive pressure checking for correction. More specifically, the program proceeds to a step S313, wherein the variation PVARIC is set to "0", and then at the step S312 abnormality determination is carried out. That is, if the flag FNGKUSA is set to "1", as stated before, the tank internal pressure PTANK is held at a value equal to or close to the atmospheric pressure, which means that the positive pressure checking for correction is not required, thereby omitting the pressure cancellation and the positive pressure checking for correction. Thereafter, the puff loss valve 22 and purge control valve 30 are opened, the bypass valve 24 is kept closed, and the drain shut valve 26 and jet purge control valve 29 are kept open, followed by the program returning to the normal purging mode at the step S184.

Figure 7:
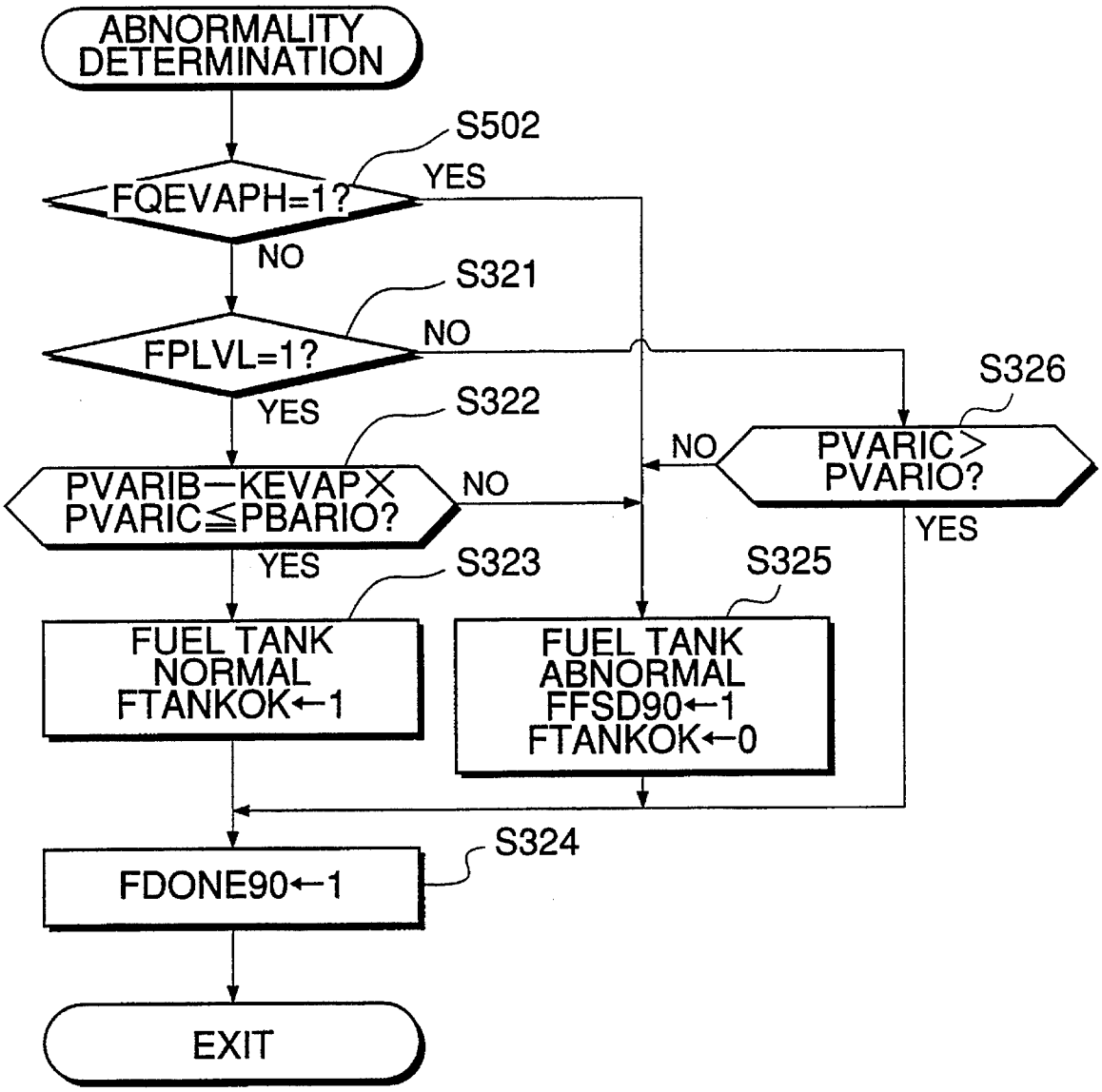
FIG. 7 is a flowchart showing a subroutine for determining abnormality of the fuel tank, which is carried out during execution of the FIG. 3B routine.

FIG. 7 shows a subroutine for executing abnormality determination, which is carried out at the step S312 in FIG. 3B.

At a step S502, it is determined whether or not the flag FQEVAPH (FIG. 5) is set to "1". If FQEVAPH="1" stands, which means that the desired purging flow rate QEVAP is held at the upper limit value, it is determined that there is a leak from the fuel tank side, and then a flag FFSD90 is set to "1", and the flag FTANKOK is set to "0" at a step S325. Further, the flag FDONE90, which, when set to "1", indicates that the fuel tank negative pressurization has been completed, is set to "1" at a step S324, followed by terminating the routine.

If the answer to the question of the step S502 is negative (NO), i.e. FQEVAPH="0" stands, the program proceeds to a step S321, wherein it is determined whether or not the flag FPLVL, which, when set to "1", indicates that the fuel tank negative pressurization has been completed within the predetermined time period T12, is set to "1". If the answer to the question is affirmative (YES), the program proceeds to a step S322, wherein it is determined whether or not the difference between the PVARIB value and the product of KEVAP×PVARIC is smaller than a predetermined value PVARIO. If the answer to the question is affirmative (YES), it is determined at a step S323 that the fuel tank side is in a normal state, and accordingly the flag FTANKOK is set to "1", followed by executing the step S324 and then terminating the present routine. KEVAP represents a coefficient which is determined in response to the desired negative pressurization pressure value, by the use of a KEVAP table, not shown, such that it is set to a larger value as the desired negative pressurization pressure value becomes larger. The rate of generation of evaporative fuel varies with a change in the tank internal pressure, and therefore, the coefficient KEVAP is provided for correcting the determination level according to the desired negative pressurization pressure value so as to compensate for the variation of the generation rate. More specifically, the PVARIB value represents an amount of variation in the tank internal pressure PTANK with respect to a negatively pressurized state (desired negative pressurization pressure value) during execution of the leak down checking, while the PVARIC value represents an amount of variation in the tank internal pressure PTANK with respect to the atmospheric pressure during execution of the positive pressurization for correction. Generation of evaporative fuel is suppressed to a larger degree as the tank internal pressure increases, and therefore the rate of generation of evaporative fuel is different between during leak down checking and during positive pressurization for correction. In the present embodiment, by virtue of the provision of the coefficient KEVAP which is set with the difference in the rate of generation of evaporative fuel taken into account, the determination accuracy can be improved.

If the answer to the question at the step S322 is negative (NO), it is determined that a leak has been occurring from the fuel tank side, and then steps S324 et seq. are executed, followed by terminating the routine.

On the other hand, if the answer to the question at the step S321 is negative (NO), i.e. if the flag FPLVL is set to "0", it is determined whether or not the PVARIC value is larger than the predetermined value PVARIO at a step S326. If the answer to the question is negative (NO), the program proceeds to the step S325, wherein it is determined that the fuel tank side suffers from a leak, and the flags FFSD90 and FTANKOK are set to "1" and "0", respectively, as stated above, followed by executing the step S324 and then terminating the routine. If the answer to the question at the step S326 is affirmative (YES), the program skips over the step 8325 to the step S324 to execute same, followed by terminating the present routine.

Although in the above described embodiment the fuel tank negative pressurization is terminated when the predetermined time period T13 elapses after the QEVAP value reaches the lower limit value QEVAPL, this is not limitative, but it may be terminated immediately when the QEVAP value reaches the lower limit value QEVAPL.

What is claimed is:

1. In an evaporative fuel-processing system for an internal combustion engine having an intake system, and a fuel tank, including evaporative emission control means having a canister for adsorbing evaporative fuel generated within said fuel tank, a charging passage extending between said canister and said fuel tank, a purging passage extending between said canister and said intake system of said engine, an open-to-atmosphere passage for communicating an interior of said canister with the atmosphere, a purge control valve arranged in said purging passage, for opening and closing said purging passage, said purge control valve having a valve opening amount thereof being controllable, an open-to-atmosphere valve arranged in said open-to-atmosphere passage, for selectively opening and closing said open-to-atmosphere passage, and pressure detecting means arranged in said evaporative emission control means, for detecting pressure within said evaporative emission control means, the improvement comprising:

negative pressure-introducing means for introducing negative pressure from said intake system of said engine into said evaporative emission control means and said fuel tank by opening said purge control valve and closing said open-to-atmosphere valve; and purge control means operable when said negative pressure-introducing means is operating, for comparing a value of said pressure within said evaporative emission control means detected by said pressure detecting means with a predetermined negative pressure value, and for controlling said valve opening amount of said purge control valve so as to vary a flow rate of said evaporative fuel to be purged into said intake system, based on results of said comparison.

2. An evaporative fuel-processing system as claimed in claim 1, wherein said purge control means compares said value of said pressure within said evaporative emission control means detected by said pressure detecting means with a first predetermined negative pressure value and a second predetermined negative pressure value which is lower than said first predetermined negative pressure value, said purge control means progressively increasing said valve opening amount of said purge control valve when said value of said pressure within said evaporative emission control means detected by said pressure detecting means reaches said first predetermined negative pressure value, and progressively decreasing said valve opening amount of said purge control valve when said value of said pressure within said evaporative emission control means detected by said pressure detecting means reaches said second predetermined negative pressure value.

3. An evaporative fuel-processing system as claimed in claim 1, wherein said purge control means changes said predetermined pressure value according to time elapsed after said negative pressure-introducing means starts to introduce said negative pressure from said intake system of said engine into said evaporative emission control means and said fuel tank.

4. An evaporative fuel-processing system as claimed in claim 2, wherein said purge control means changes said second predetermined negative pressure value such that it progressively becomes closer to said first predetermined negative pressure value as time elapses after the start of introduction of said negative pressure into said evaporative emission control means and said fuel tank.

5. An evaporative fuel-processing system as claimed in claim 2, wherein said first and second predetermined pressure values are an upper limit value and a lower limit value of a desired negative pressure value to which pressure within said evaporative emission control means is to be reduced by said introduction of said negative pressure into said evaporative emission control means and said fuel tank by said negative pressure-introducing means, respectively.

6. An evaporative fuel-processing system as claimed in claim 1, wherein said negative pressure-introducing means terminates said introduction of said negative pressure into said evaporative emission control means and said fuel tank when said valve opening amount of said purge control valve reaches a predetermined lower limit value after the start of said introduction of said negative pressure into said evaporative emission control means and said fuel tank.

7. An evaporative fuel-processing system as claimed in claim 2, wherein said negative pressure-introducing means terminates said introduction of said negative pressure into said evaporative emission control means and said fuel tank when said valve opening amount of said purge control valve reaches a predetermined lower limit value after the start of said introduction of said negative pressure into said evaporative emission control means and said fuel tank.

8. An evaporative fuel-processing system as claimed in claim 1, wherein said negative pressure-introducing means terminates said introduction of said negative pressure into said evaporative emission control means and said fuel tank when a predetermined period of time elapses after said valve opening amount of said purge control valve reaches a predetermined lower limit value after the start of said introduction of said negative pressure into said evaporative emission control means and said fuel tank.

9. An evaporative fuel-processing system as claimed in claim 2, wherein said negative pressure-introducing means terminates said introduction of said negative pressure into said evaporative emission control means and said fuel tank when a predetermined period of time elapses after said valve opening amount of said purge control valve reaches a predetermined lower limit value after the start of said introduction of said negative pressure into said evaporative emission control means and said fuel tank.

10. An evaporative fuel-processing system as claimed in claim 1, wherein said negative pressure-introducing means terminates said introduction of said negative pressure into said evaporative emission control means and said fuel tank if said valve opening amount of said purge control valve does not yet reach a predetermined lower limit value when a predetermined period of time elapses after the start of said introduction of said negative pressure into said evaporative emission control means and said fuel tank.

11. An evaporative fuel-processing system as claimed in claim 2, wherein said negative pressure-introducing means terminates said introduction of said negative pressure into said evaporative emission control means and said fuel tank if said valve opening amount of said purge control valve does not yet reach a predetermined lower limit value when a predetermined period of time elapses after the start of said introduction of said negative pressure into said evaporative emission control means and said fuel tank.

12. An evaporative fuel-processing system as claimed in claim 1, further including open-loop purge control means operable when said negative pressure-introducing means is operating, for controlling said valve opening amount of said purge control valve, irrespective of said value of said pressure within said evaporative emission control means detected by said pressure detecting means.

13. An evaporative fuel-processing system as claimed in claim 12, wherein said open-loop purge control means executes said control of said valve opening amount of said purge control valve, before said said first-mentioned purge control means operates to control said valve opening amount.

14. An evaporative fuel-processing system as claimed in claim 13, wherein said open-loop purge control means terminates said control of said valve opening amount of said purge control valve when said pressure within said evaporative emission control means reaches a second predetermined negative pressure value.

15. An evaporative fuel-processing system as claimed in claim 13, wherein said negative pressure-introducing means terminates said introduction of said negative pressure into said evaporative emission control means and said fuel tank if said pressure within said evaporative emission control means does not yet reach said second predetermined negative pressure value when a predetermined period of time elapses after the start of said introduction of said negative pressure into said evaporative emission control means and said fuel tank.

16. An evaporative fuel-processing system as claimed in claim 2, further including open-loop purge control means operable when said negative pressure-introducing means is operating, for controlling said valve opening amount of said purge control valve, irrespective of said value of said pressure within said evaporative emission control means detected by said pressure detecting means.

17. An evaporative fuel-processing system as claimed in claim 16, wherein said open-loop purge control means executes said control of said valve opening amount of said purge control valve, before said said first-mentioned purge control means operates to control said valve opening amount.

18. An evaporative fuel-processing system as claimed in claim 17, wherein said open-loop purge control means terminates said control of said valve opening amount of said purge control valve when said pressure within said evaporative emission control means reaches a third predetermined negative pressure value.

19. An evaporative fuel-processing system as claimed in claim 17, wherein said negative pressure-introducing means terminates said introduction of said negative pressure into said evaporative emission control means and said fuel tank if said pressure within said evaporative emission control means does not yet reach said third predetermined negative pressure value when a predetermined period of time elapses after the start of said introduction of said negative pressure into said evaporative emission control means and said fuel tank.

20. In an evaporative fuel-processing system for an internal combustion engine having an intake system, and a fuel tank, including evaporative emission control means having a canister for adsorbing evaporative fuel generated within said fuel tank, a charging passage extending between said canister and said fuel tank, a purging passage extending between said canister and said intake system of said engine, an open-to-atmosphere passage for communicating an interior of said canister with the atmosphere, a purge control valve arranged in said purging passage, for opening and closing said purging passage, an open-to-atmosphere valve arranged in said open-to-atmosphere passage, for selectively opening and closing said open-to-atmosphere passage, and pressure detecting means arranged in said evaporative emission control means, for detecting pressure within said evaporative emission control means, the improvement comprising:

negative pressure-introducing means for introducing negative pressure from said intake system of said engine into said evaporative emission control means and said fuel tank by opening said purge control valve and closing said open-to-atmosphere valve; and purge control means operable when said negative pressure-introducing means is operating, for comparing a value of said pressure within said evaporative emission control means detected by said pressure detecting means with a predetermined negative pressure value, and for controlling said purge control valve so as to vary a flow rate of said evaporative fuel to be purged into said intake system, based on results of said comparison.

21. In an evaporative fuel-processing system for an internal combustion engine having an intake system, and a fuel tank, including evaporative emission control means having a canister for adsorbing evaporative fuel generated within said fuel tank, a charging passage extending between said canister and said fuel tank, a purging passage extending between said canister and said intake system of said engine, an open-to-atmosphere passage for communicating an interior of said canister with the atmosphere, a purge control valve arranged in said purging passage, for opening and closing said purging passage, said purge control valve having a valve opening amount thereof being controllable, an open-to-atmosphere valve arranged in said open-to-atmosphere passage, for selectively opening and closing said open-to-atmosphere passage, and pressure detecting means arranged in said evaporative emission control means, for detecting pressure within said evaporative emission control means, the improvement comprising:

negative pressure-introducing means for introducing negative pressure from said intake system of said engine into said evaporative emission control means and said fuel tank by opening said purge control valve and closing said open-to-atmosphere valve; and purge control means operable when said negative pressure-introducing means is operating, for comparing a value of said pressure within said evaporative emission control means detected by said pressure detecting means with a predetermined negative pressure value, and for controlling said valve opening amount of said purge control valve, based on results of said comparison, wherein said purge control means compares said value of said pressure within said evaporative emission control means detected by said pressure detecting mean with a first predetermined negative pressure value and a second predetermined negative pressure value which is lower than said first predetermined negative pressure value, said purge control means progressively increasing said valve opening amount of said purge control valve when said value of said pressure within said evaporative emission control means detected by said pressure detecting means reaches said first predetermined negative pressure value, and progressively decreasing said valve opening amount of said purge control valve when said value of said pressure within said evaporative emission control means detected by said pressure detecting means reaches said second predetermined negative pressure value.

22. An evaporative fuel-processing system as claimed in claim 21, wherein said purge control means changes said second predetermined negative pressure value such that it progressively becomes closer to said first predetermined negative pressure value as time elapses after the start of introduction of said negative pressure into said evaporative emission control means and said fuel tank.

23. An evaporative fuel-processing system as claimed in claim 21, wherein said first and second predetermined pressure values are an upper limit value and a lower limit value of a desired negative pressure value to which pressure within said evaporative emission control means is to be reduced by said introduction of said negative pressure into said evaporative emission control means and said fuel tank by said negative pressure-introducing means, respectively.

24. An evaporative fuel-processing system as claimed in claim 21, wherein said negative pressure-introducing means terminates said introduction of said negative pressure into said evaporative emission control means and said fuel tank when said valve opening amount of said purge control valve reaches a predetermined lower limit value after the start of said introduction of said negative pressure into said evaporative emission control means and said fuel tank.

25. An evaporative fuel-processing system as claimed in claim 21, wherein said negative pressure-introducing means terminates said introduction of said negative pressure into said evaporative emission control means and said fuel tank when a predetermined period of time elapses after said valve opening amount of said purge control valve reaches a predetermined lower limit value after the start of said introduction of said negative pressure into said evaporative emission control means and said fuel tank.

26. An evaporative fuel-processing system as claimed in claim 21, wherein said negative pressure-introducing means terminates said introduction of said negative pressure into said evaporative emission control means and said fuel tank if said valve opening amount of said purge control valve does not yet reach a predetermined lower limit value when a predetermined period of time elapses after the start of said introduction of said negative pressure into said evaporative emission control means and said fuel tank.

27. In an evaporative fuel-processing system for an internal combustion engine having an intake system, and a fuel tank, including evaporative emission control means having a canister for adsorbing evaporative fuel generated within said fuel tank, a charging passage extending between said canister and said fuel tank, a purging passage extending between said canister and said intake system of said engine, an open-to-atmosphere passage for communicating an interior of said canister with the atmosphere, a purge control valve arranged in said purging passage, for opening and closing said purging passage, said purge control valve having a valve opening amount thereof being controllable, an open-to-atmosphere valve arranged in said open-to-atmosphere passage, for selectively opening and closing said open-to-atmosphere passage, and pressure detecting means arranged in said evaporative emission control means, for detecting pressure within said evaporative emission control means, the improvement comprising:

negative pressure-introducing means for introducing negative pressure from said intake system of said engine into said evaporative emission control means and said fuel tank by opening said purge control valve and closing said open-to-atmosphere valve;

purge control means operable when said negative pressure-introducing means is operating, for comparing a value of said pressure within said evaporative emission control means detected by said pressure detecting means with a predetermined negative pressure value, and for controlling said valve opening amount of said purge control valve, based on results of said comparison; and open-loop purge control means operable when said negative pressure-introducing means is operating, for controlling said valve opening amount of said purge control valve, irrespective of said value of said pressure within said evaporative emission control means detected by said pressure detecting means, wherein said open-loop purge control means executes said control of said valve opening amount of said purge control valve, before said purge control means operates to control said valve opening amount, and wherein said open-loop purge control means terminates said control of said valve opening amount of said purge control valve when said pressure within said evaporative emission control means reaches a second predetermined negative pressure value.

28. In an evaporative fuel-processing system for an internal combustion engine having an intake system, and a fuel tank, including evaporative emission control means having a canister for adsorbing evaporative fuel generated within said fuel tank, a charging passage extending between said canister and said fuel tank, a purging passage extending between said canister and said intake system of said engine, an open-to-atmosphere passage for communicating an interior of said canister with the atmosphere, a purge control valve arranged in said purging passage, for opening and closing said purging passage, said purge control valve having a valve opening amount thereof being controllable, an open-to-atmosphere valve arranged in said open-to-atmosphere passage, for selectively opening and closing said open-to-atmosphere passage, and pressure detecting means arranged in said evaporative emission control means, for detecting pressure within said evaporative emission control means, the improvement comprising:

negative pressure-introducing means for introducing negative pressure from said intake system of said engine into said evaporative emission control means and said fuel tank by opening said purge control valve and closing said open-to-atmosphere valve;

purge control means operable when said negative pressure-introducing means is operating, for comparing a value of said pressure within said evaporative emission control means detected by said pressure detecting means with a predetermined negative pressure value, and for controlling said valve opening amount of said purge control valve, based on results of said comparison; and open-loop purge control means operable when said negative pressure-introducing means is operating, for controlling said valve opening amount of said purge control valve, irrespective of said value of said pressure within said evaporative emission control means detected by said pressure detecting means, wherein said open-loop purge control means executes said control of said valve opening amount of said purge control valve, before said purge control means operates to control said valve opening amount, and wherein said negative pressure-introducing means terminates said introduction of said negative pressure into said evaporative emission control means and said fuel tank if said pressure within said evaporative emission control means does not yet reach said second predetermined negative pressure value when a predetermined period to time elapses after the start of said introduction of said negative pressure into said evaporative emission control means and said fuel tank.

29. An evaporative fuel-processing system as claimed in claim 21, further including open-loop purge control means operable when said negative pressure-introducing means is operating, for controlling said valve opening amount of said purge control valve, irrespective of said value of said pressure within said evaporative emission control means detected by said pressure detecting means.

30. An evaporative fuel-processing system as claimed in claim 29, wherein said open-loop purge control means executes said control of said valve opening amount of said purge control valve, before said said purge control means operates to control said valve opening amount.

31. An evaporative fuel-processing system as claimed in claim 30, wherein said open-loop purge control means terminates said control of said valve opening amount of said purge control valve when said pressure within said evaporative emission control means reaches a third predetermined negative pressure value.

32. An evaporative fuel-processing system as claimed in claim 30, wherein said negative pressure-introducing means terminates said introduction of said negative pressure into said evaporative emission control means and said fuel tank if said pressure within said evaporative emission control means does not yet reach said third predetermined negative pressure value when a predetermined period of time elapses after the start of said introduction of said negative pressure into said evaporative emission control means and said fuel tank.

* * * * *